United States Patent [19]

Hughes

[11] Patent Number: 4,622,834

[45] Date of Patent: Nov. 18, 1986

[54] KEY ASSEMBLY

[76] Inventor: Donald R. Hughes, 2600 Brower Ave., Simi Valley, Calif. 93065

[21] Appl. No.: 737,672

[22] Filed: May 24, 1985

[51] Int. Cl.[4] ..... E05B 19/10

[52] U.S. Cl. ..... 70/395; 70/404; 70/411

[58] Field of Search ..... 70/395, 411, 409, 402–404

[56] References Cited

U.S. PATENT DOCUMENTS

| | | | |
|---|---|---|---|
| 1,401,044 | 12/1921 | Clark | 70/411 |
| 1,984,202 | 12/1934 | Shinn | 70/404 |
| 2,204,740 | 6/1940 | Whitney | 70/404 |
| 3,142,167 | 7/1964 | Christopher | 70/411 |
| 3,408,840 | 11/1968 | Hasenbein | 70/404 |
| 3,509,749 | 5/1970 | Regan et al. | 70/395 |
| 3,681,957 | 8/1972 | Sturgeon | 70/404 X |
| 3,727,440 | 4/1973 | Greenwald et al. | 70/411 |
| 4,094,176 | 6/1978 | Hughes | 70/411 X |

FOREIGN PATENT DOCUMENTS

| | | | |
|---|---|---|---|
| 443918 | 3/1936 | United Kingdom | 70/404 |
| 519739 | 4/1940 | United Kingdom | 70/411 |

*Primary Examiner*—Robert L. Wolfe
*Assistant Examiner*—Lloyd A. Gall
*Attorney, Agent, or Firm*—Jack C. Munro

[57] ABSTRACT

A key assembly which can be assembled to a specific code by snapping together the different parts of the key assembly. The key assembly includes a tubular, cylindrical barrel which has a plurality of spaced apart elongated grooves formed in the exterior surface of the barrel. A hole connects with each groove. A pin is to be mountable within each hole. An insert selected from a grouping of a plurality of different lengths of inserts is to be mounted within each groove with the pin for that groove being located within an appropriate opening formed within the insert thereby longitudinally fixing in position the insert with respect to the groove. A collar is then exteriorly mounted on the barrel about the inserts and fixed in position thereby preventing disengagement of the inserts from their respective grooves. A handle is mounted on the barrel.

4 Claims, 8 Drawing Figures

3
3

7
7
60
62
64
65
66
68
69
10
12
14
16
18
20
22
24
26
28
30
32
34
36
38
40
44

KEY ASSEMBLY

BACKGROUND OF THE INVENTION

The field of this invention relates to locking devices and more particularly to a key constructed of multiple parts for operating cylindrical, tubular types of locks, so that this type of key can be more easily and less expensively originated and duplicated.

The duplication of keys is normally a significant portion of business for every locksmith. At the present time, the normal method to duplicate any key requires the use of a key cutting machine. The key cutting machine is an expensive piece of equipment. Not only for well-established locksmiths but also for newly established locksmiths, such an expense can be prohibitive. Besides a straight type of key, there is also the tubular type of key. This means that a key cutting machine is not only required for the straight type of key, but also for the tubular type of key which constitutes a double machine expense.

Another disadvantage of requiring of a key cutting machine is that such machines are of substantial weight and size and not conducive to portability. Normally, portability is a requirement, since in most cases a locksmith is required to visit the site of a locksmithing situation. This means that the machine must be readily carried within a small truck or van. Still further, such machines require operation by electricity. At times, in certain situations, electricity may not be readily convenient.

Besides the aforementioned disadvantages in the duplicating of keys, there is also the disadvantage that the key that is duplicated is produced from another key. This other key is frequently worn through usage. Therefore, the wear of this master key is reproduced in the duplicate key. This amount of wear, coupled with a small amount of machine tolerance of the key cutting machine, frequently results in a key that will not work the lock for which it is intended. The duplicated key cannot be better than the key from which it was duplicated.

Previously, there has been an attempt by the present inventor to construct a key assembly which does not require the use of a key cutting machine to produce a duplicated key. This key assembly is defined within U.S. Pat. No. 4,045,983, issued Sept. 6, 1977, entitled "UNIVERSAL BARREL KEY APPARATUS". The subject matter of the present invention is an improvement over the structure of the aforementioned patent.

SUMMARY OF THE INVENTION

The key assembly of the present invention is constructed of a tubular, cylindrical, metallic barrel, which includes an internal chamber. The internal chamber is open at the front end. Formed in the exterior wall surface of the barrel are a series of spaced apart elongated grooves. Each of the grooves are of the same width and of the same length. Formed within the barrel in the area of each groove is a hole. A plug is to be mounted within the interior chamber directly adjacent the series of holes. A pin is to be mounted within each hole and abut against the plug. An elongated planar strip-like insert is to be mounted within each groove. There are available inserts of different lengths with a particular lengthed insert to be selected for a particular groove. Each insert includes a hole within which the head of the pin is to be located. When the inserts are properly positioned about the barrel, a collar is placed around the aft portion of the inserts in a close fitting manner thereby maintaining such in their established position. The barrel can optionally be connected to a graspable cylindrical type of handle, which is threadibly connected to the barrel, or can be connected to a flat handle with the aft portion of the barrel crimped to the flat handle thereby being fixedly secured thereto.

The primary objective to the present invention is to construct a key for a lock in which the key can be produced without the use of any key cutting machine.

Another objective of the present invention is to construct a key assembly in which all parts can be manufactured by conventional manufacturing techniques with the resulting overall assembly being constructed inexpensively, and, therefore, being capable of being sold to the consumer inexpensively.

DETAILED DESCRIPTION OF THE SHOWN EMBODIMENT

Figures 1, 2:
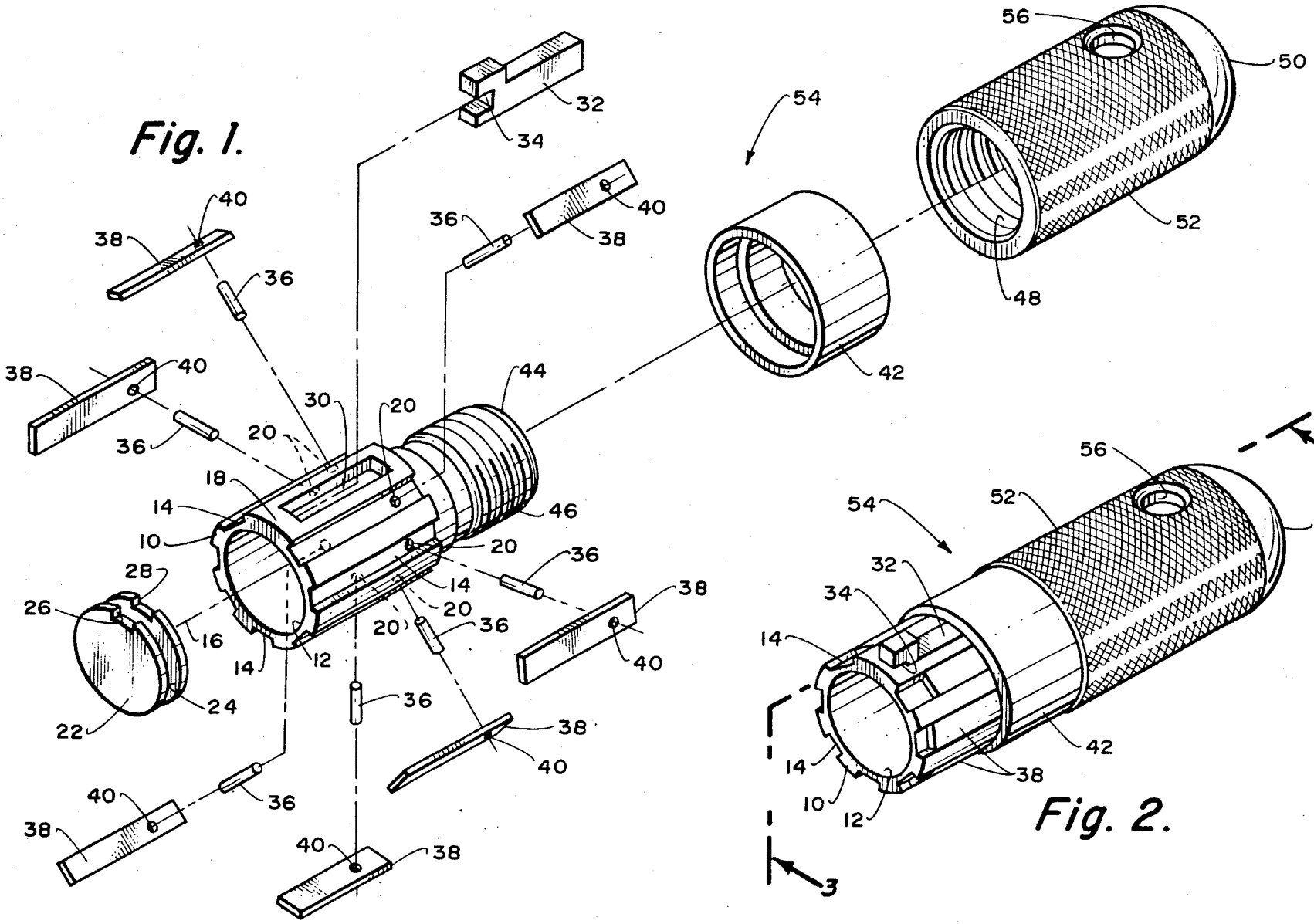
FIG. 1 is an exploded isometric view of the key assembly of the present invention which utilizes a cylindrical shaped handle.
FIG. 2 is an isometric view of the key assembly of FIG. 1, showing the key assembly in the assembled state.
Figure 4:
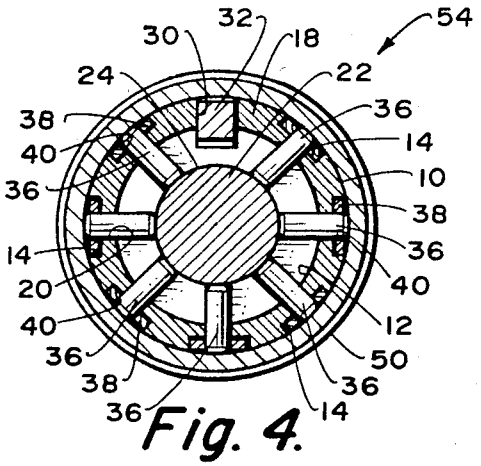
FIG. 4 is a cross-sectional view taken along line 4—4 of FIG. 3.
Figure 8:
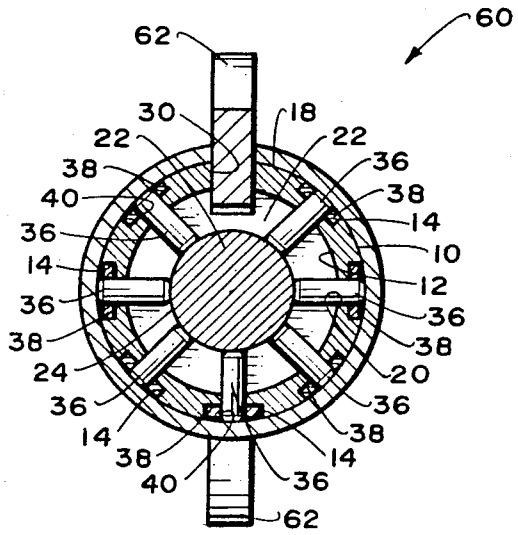
FIG. 8 is a transverse cross-sectional view taken along line 8—8 of FIG. 7.
Figure 3:
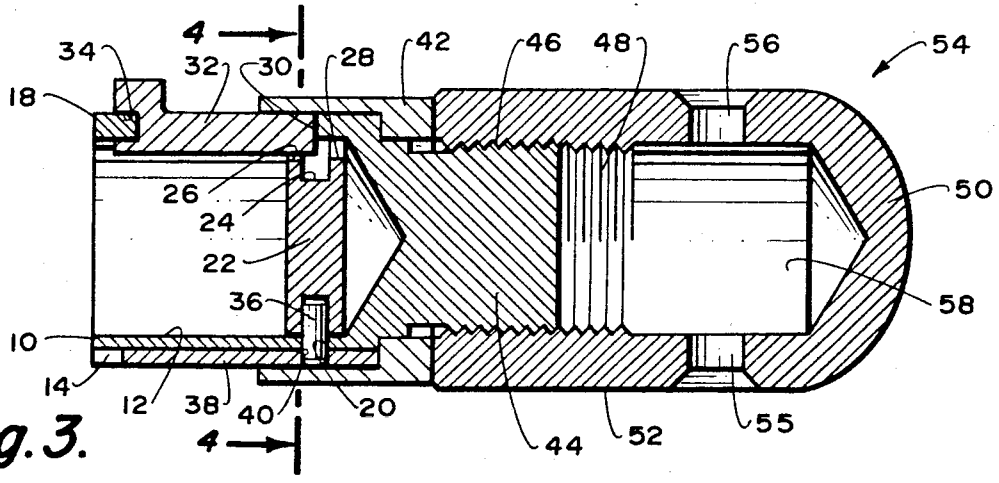
FIG. 3 is a cross-sectional view through the key assembly of FIGS. 1 and 2 taken along line 3—3 of FIG. 2.
Figure 7:
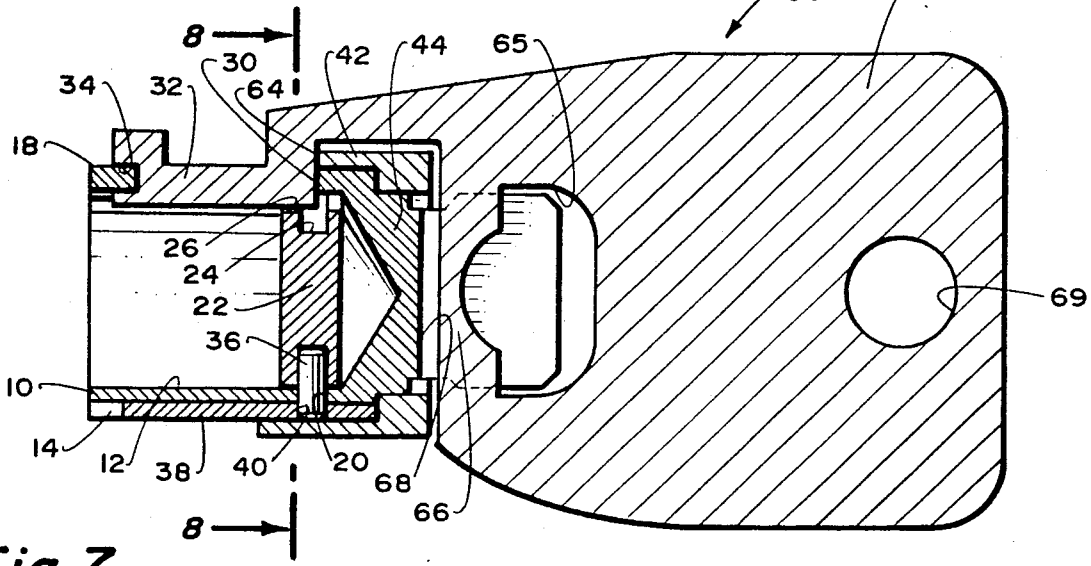
FIG. 7 is a longitudinal cross-sectional view taken along line 7—7 of FIG. 6.
Figures 5, 6:
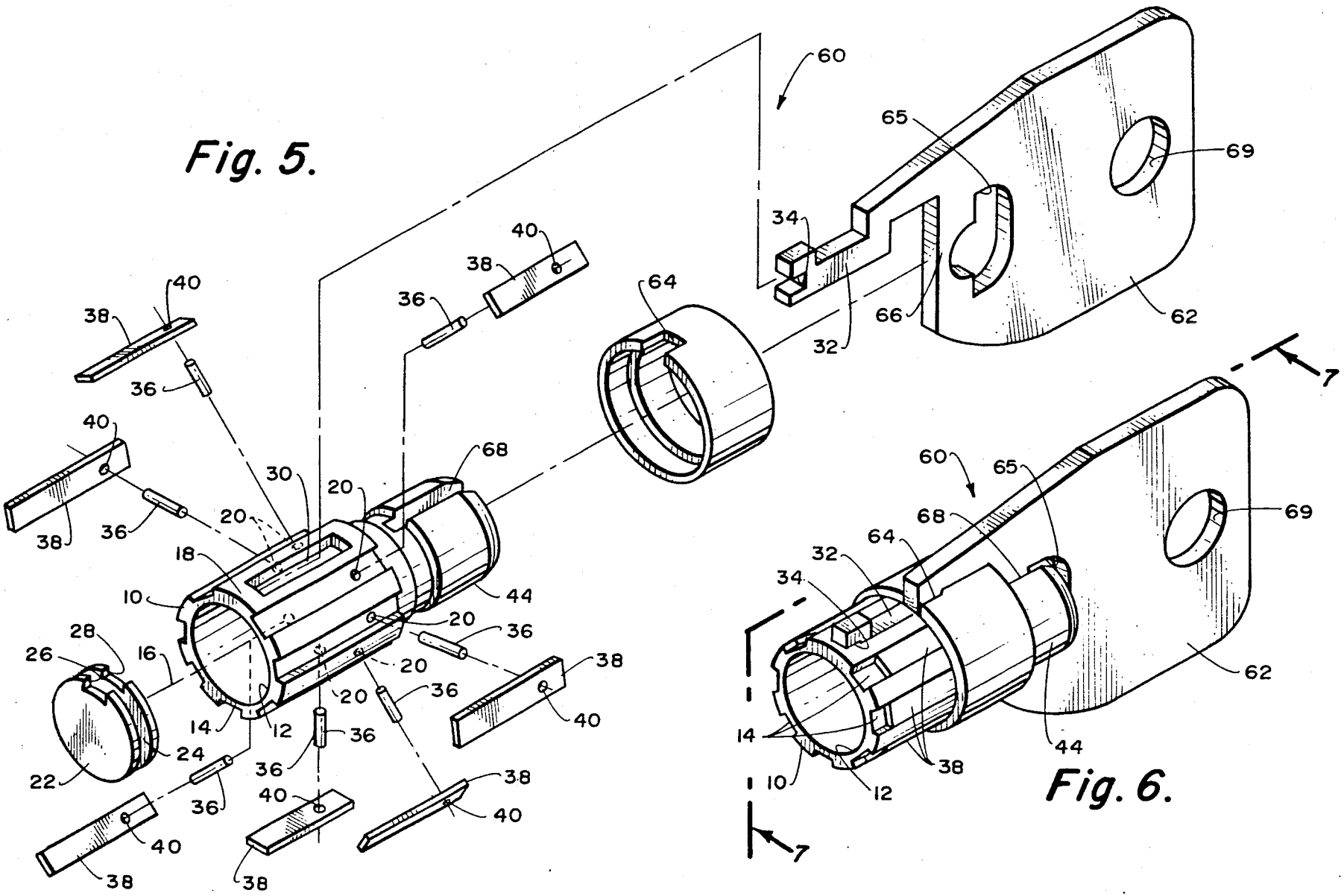
FIG. 5 is an isometric view similar to FIG. 1, but showing the flat handle utilized in conjunction with the key assembly of the present invention.
FIG. 6 is a view similar to FIG. 2, but of the flat handle version of the key assembly of this invention.

Referring to the drawings, there is shown in FIGS. 1 to 4 a first version of the invention, with a second version of the invention being shown in FIGS. 5 through 8. The similarity in structure between the two versions will be described using the same reference numerals. The structural differences between the two versions will then be described using differentiating reference numerals.

Referring particularly to FIGS. 1 through 8, there is shown a tubular, cylindrical barrel 10 which is constructed of a rigid material such as brass. The barrel 10 includes an interior cylindrical chamber 12 and a series of grooves 14 formed within the exterior wall of the barrel 10. The tubular barrel 10 has a longitudinal center axis 16. The longitudinal axis of each of the grooves 14 is located parallel to the axis 16. It is to be noted that there are seven in number of the grooves 14. However, the number of these grooves is considered to be a matter of choice. It is also to be noted that for the most part the grooves 14 are evenly spaced apart with the exception being in the area of elongated protrusion 18. It is also to be noted that each of the grooves 14 have a planar bottom surface with planar sidewalls which are perpendicular to the bottom surface. The grooves 14 are all of the same length.

Formed through the wall of the tubular barrel 10 within each of the grooves 14 is a hole 20. Since there are seven in number of the grooves 14, there will also be seven in number of the holes 20. Each hole 20 is located generally in the aft area of each of the grooves 14. The aft area is defined as being opposite the fore area which is located directly adjacent the open end of the interior chamber 12.

To be mounted within the interior chamber 12 in a close fitting, but yet slidable manner, is a plug 22. The plug 22 is basically in the form of a disc. Within the annular peripheral surface of the plug 22 there is an annular groove 24. Also formed within the annular peripheral surface of the plug 22 transverse to the groove 24 are a pair of aligned notches 26 and 28.

Formed within the protrusion 18 through the sidewall of the barrel 10 is an elongated rectangularly shaped slot 30. The plug 22 is to be inserted within the interior chamber 12 and slid to a position so that the annular grooves 24 is located directly adjacent the holes 20. Also, the notches 26 and 28 are to be aligned with the elongated slot 30. Once this position has been obtained a rib 32 is located within the elongated slot 30. The forward end of the rib 32 includes a notch 34. The fore section of the protrusion 18 is to be snugly located within the notch 34. The portion of the rib 32 which extends from the wall surface of the barrel 10 is to matingly engage with an opening formed within a tubular lock mechanism (not shown). The function of this section of the rib 32 is to correctly initially engage the barrel 10 of this invention with the lock mechanism. It is to be understood that the rib 32 also rests within the notches 26 and 28 of the plug 22.

With the plug 22 in the position directly adjacent holes 20, there is to be located within each hole 20 a pin 36. Each pin 36 is of the same length and when located fully within the annular groove 24, the outer end of each of the pins 36 is located substantially flush with the annular outer surface of the barrel 10. However, each pin 36 does protrude above the bottom wall surface of each groove 14.

An insert 38 is to be located within each groove 14 in a close fitting manner. There will be available a plurality of different lengths of inserts 38. Actually, the inerts will be divided into a series of groups with one group being numbered "1", the second group being numbered "2", and so forth. In actual practice, there will probably be ten different groups. Each group will be of a precise length when taken in conjunction with the length of each groove 14. It is to be understood that no insert 38 will be of a length greater than any groove 14.

Each of the inserts 38 include a hole 40. A pin 36 is to be located within the hole 40 for the particular insert 38 that is mounted within the groove 14 with which the pin 36 connects. Therefore, the pins 36 longitudinally fix in position the inserts 38. As a result, the different inserts 38 produce different lengths of recessed sections of the grooves 14 within the fore end of the barrel 10. When the barrel 10 is engaged with a lock (not shown), there is to be a spring biased pin within that lock to engage with each groove 14. Movement against the spring biased pins occurs by means of the forward most end of each of the inserts 38. By proper selecting of the length of each of the inserts 38 according to the specific lock mechanism, when the barrel 10 is properly positioned with the lock mechanism, each of the spring biased pins within the lock mechanism are located at a position so that the lock mechanism can be pivoted resulting in operation of such. It is to be noted that the thickness of each of the inserts 38 is such that they are also located substantially flush with the outer exterior surface of the barrel 10.

It is to be understood that once a lock mechanism has been decoded and as the different length inserts are selected according to the code of the lock and are positioned within the grooves 14, there will normally be used some type of an elastic band (not shown) to be temporarily located about the barrel 10 to hold the inserts 38 in position preventing disengagement of the inserts 38 from the barrel 10. Upon all the inserts 38 being mounted within the grooves 14, a collar 42 is slid over the aft end 44 of the barrel 10. The collar 42 includes an interior annular stepped configuration to be closely positioned about the exterior surface of the barrel 10. The collar 42, the pins 36 and the plug 22 combine as a retaining structure to hold the inserts 38 in position.

Referring now particularly to FIGS. 1 through 4, the aft end 44 has formed thereon a series of screw threads 46. The screw threads 46 are to threadably engage with the interior thread 48 of a cylindrical handle member 50. With the cylindrical handle member 50 tightened completely upon the threads 46, the forward edge of the handle member 50 will abut tightly against the collar 42 securing such in position about the barrel 10 thereby fixing in position each of the inserts 38 with respect of the barrel 10. At this particular time the elastic band (not shown) is to be removed from the exterior surface of the barrel 10 and discarded. The handle member 50 will normally include knurling 52 on its exterior surface thereof to facilitate manual grasping and operation of the resulting key 54 of FIGS. 1 through 4. Member 50 will normally include aligned holes 55 and 56 which connect with internal compartment 58 on the handle member 50. The function of the holes 55 and 56 is to permit conducting therethrough of a key chain or other similar type of structure for mounting of the key 54 thereon.

Referring particularly to FIGS. 5 through 8 of the drawings, there is shown the second version 60 of the key of this invention which utilizes instead of the cylindrical handle 50 a flat handle 62. The flat handle 62 is integrally connected to the rib 32 with the integral connection being located within a notch 64 formed within the collar 42. It is to be understood that collar 42 is modified within the version 60 where it is not so modified within the version 50. It is to be further understood that the rib 32 engages with elongated slot 30 in the same manner as within the first version of this invention.

The flat handle 62 includes a cutout section 65 which is closed off by a bridge 66. With the notch 34 in its proper position, the bridge 66 is to be located within gap area 68 formed within the aft end 44 of the version 60. In order to fixedly secure the flat handle 62 to the barrel 10, a person only need to deform, as by crimping, the aft end 44 partially closing of the gap area 68 tightly onto the bridge 66 thereby securing in position not only the handle 62 to the barrel 10, but also the position of the collar 42 onto the barrel 10. The flat handle 62 may also include a hole 69 to facilitate connection of the version 60 onto a key ring or other similar type of mounting structure (not shown).

What is claimed is:

1. Key assembly comprising:

a handle adapted to be grasped by a human being;

a barrel attached by attaching means to said handle, said barrel having a series of grooves, said barrel being tubular defining a cylindrical wall surface enclosing an interior chamber, said barrel having a longitudinal center axis, said grooves being formed within said cylindrical wall surface, the longitudinal axis of each said groove being located substantially parallel to said longitudinal center axis;

a plurality of inserts, said inserts being divided into groups of different lengths, each said insert being capable of matingly cooperating with each said groove;

retaining means for fixing the position of said inserts on said barrel, said retaining means including a collar exteriorly mounted across said inserts tightly holding said inserts in place within said grooves;

said retaining means further including a plurality of pins, a said pin to connect with a said insert, said barrel including a plurality of locating openings, a said pin to connect with a said locating opening, said pins being radially aligned with respect to said barrel; and said retaining means further includes a plug, said plug being located within said interior chamber, said pins to connect with said plug.

2. The key assembly as defined in claim 1 wherein:

said handle comprising a cylindrically shaped handle member, said barrel including a series of screw threads, said cylindrically shaped handle member being connected to said barrel by said screw threads.

3. The key assembly as defined in claim 1 wherein:

said handle taking the form of a flat handle, said flat handle having a fore end, said fore end including a rib, said barrel having an elongated slot formed within said wall surface, said slot to connect with said elongated slot to interlockingly connect said flat handle to said barrel.

4. The key assembly as defined in claim 3 wherein:

said barrel including crimpable means, said crimpable means to be crimped to affix said flat handle to said barrel.

* * * * *